US005713603A

United States Patent [19]

Carter

[11] Patent Number: 5,713,603

[45] Date of Patent: Feb. 3, 1998

[54] BODY MOUNTED SAIL ASSEMBLY

[76] Inventor: Robert L. Carter, 3124 Brossman Ct., Naperville, Ill. 60564

[21] Appl. No.: 584,435

[22] Filed: Jan. 11, 1996

[51] Int. Cl.[6] ..... A63C 11/00

[52] U.S. Cl. ..... 280/810; 280/213

[58] Field of Search ..... 280/213, 810; D12/322; 244/130; 114/102, 103

[56] References Cited

U.S. PATENT DOCUMENTS

| | | | |
|---|---|---|---|
| 1,859,178 | 5/1932 | Sprinkle | 280/810 |
| 2,018,062 | 10/1935 | Hardt | 280/11.37 |
| 3,768,823 | 10/1973 | Goldberg | 280/11.37 |
| 4,130,292 | 12/1978 | Lorenz | 280/11.37 |
| 4,473,022 | 9/1984 | Eastland | 114/103 |
| 4,634,136 | 1/1987 | Alexander | 280/213 |
| 4,669,407 | 6/1987 | Cobb | 114/39 |
| 4,735,429 | 4/1988 | Beck | 280/213 |
| 4,738,460 | 4/1988 | Alexander | 280/213 |
| 4,890,861 | 1/1990 | Bachmann | 280/810 |
| 4,972,789 | 11/1990 | Greppi | 114/90 |
| 5,048,442 | 9/1991 | Hackney | 114/102 |
| 5,071,089 | 12/1991 | Fagan | 244/16 |

FOREIGN PATENT DOCUMENTS

| | | | |
|---|---|---|---|
| 1499954 | 11/1967 | France | 280/810 |
| 102888 | 5/1898 | Germany | 280/810 |

*Primary Examiner*—Richard M. Camby
*Assistant Examiner*—Bridget Avery

[57] ABSTRACT

A human body sail assembly including a rotatable mast with upper and lower horizontal sail braces that swing with the mast, the sail is tensioned by the braces and can be locked in the desired angular position by an easy to operate pawl and ratchet mechanism on the base of the mast, and the sail can be collapsed using quick release pivots at the inner ends of the sail braces.

14 Claims, 4 Drawing Sheets

Fig. 1
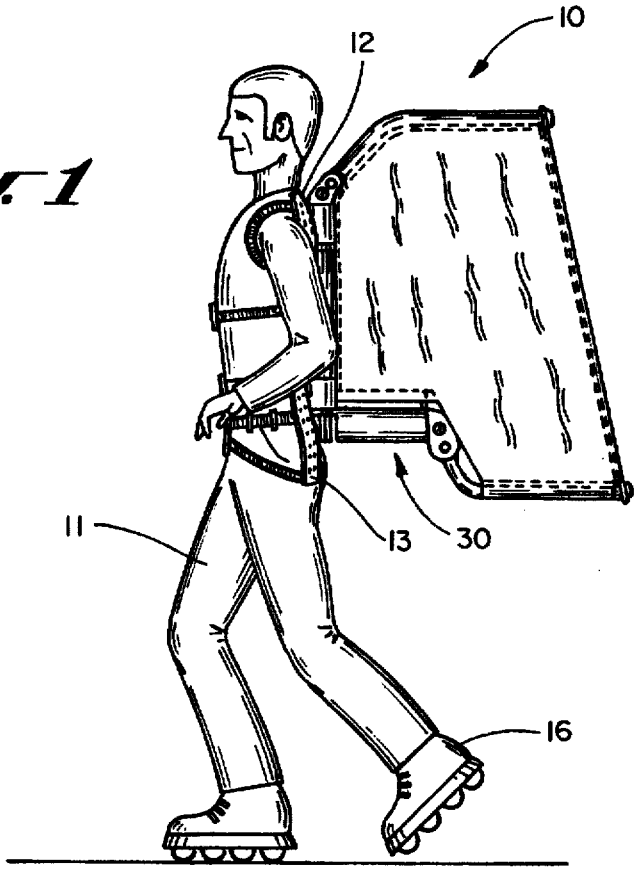
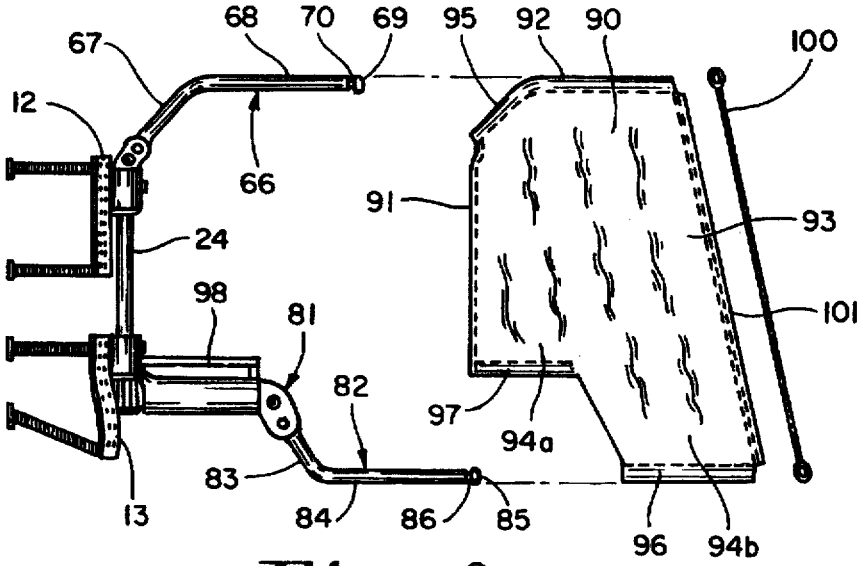
Fig. 2

Fig. 6
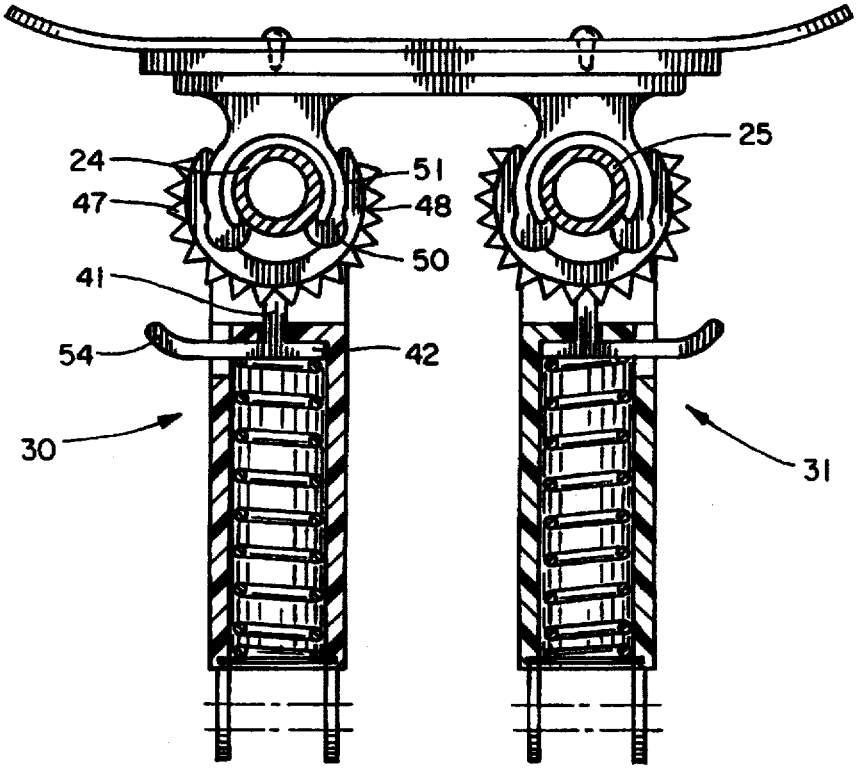
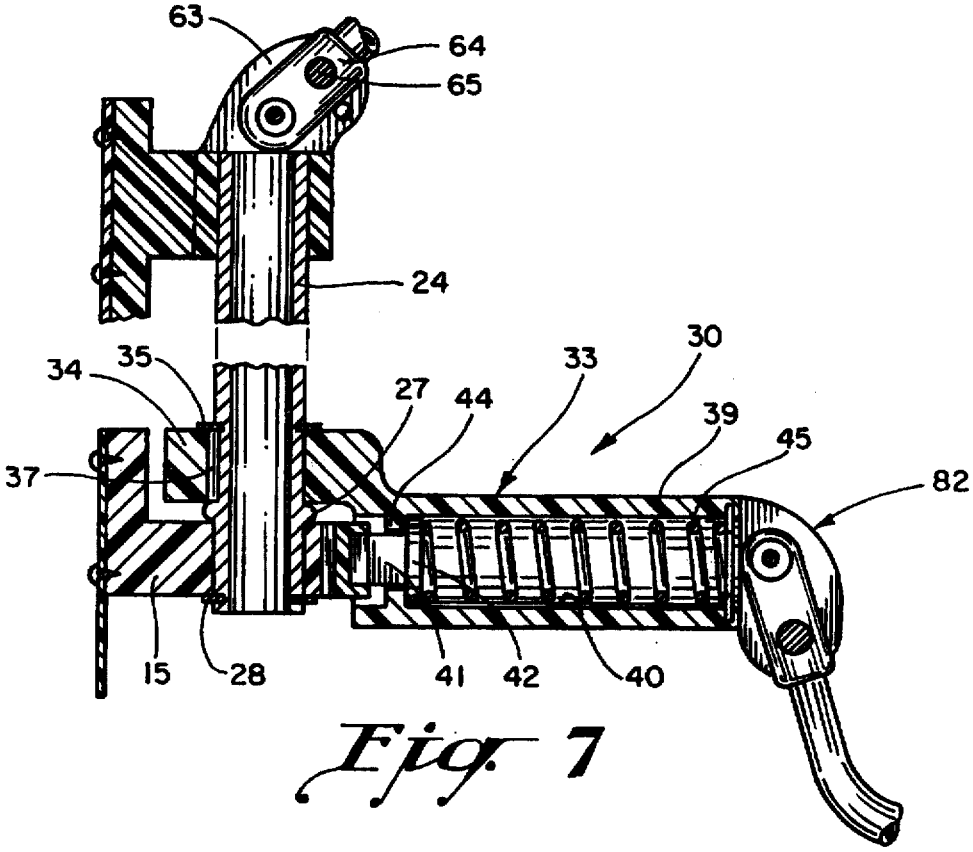
Fig. 7

BODY MOUNTED SAIL ASSEMBLY

BACKGROUND OF THE INVENTION

While the present human body sail assembly is intended for use with in-line roller blades, it certainly has other uses, and the prior art of body sails exemplifies body sails with alternative intended applications, and these prior devices are typified in the following United States and foreign patents:

UNITED STATES PATENTS

| Invention | Patent No. | Issue Date |
|---|---|---|
| Hardt | 2,018,062 | October 22, 1935 |
| Goldberg | 3,768,823 | October 30, 1973 |
| Alexander | 4,738,460 | April 19, 1988 |
| Boyden | 5,120,070 | June 9, 1992 |

FOREIGN PATENTS

M. Hespel French Patent No. 1,499,954 Sep. 25, 1967

The Alexander, U.S. Pat. No. 4,738,460, shows a rather complex body sail mechanism for a bicycle rider in which the angle of the back mounted sail is controlled by one of the bicyclist's hands on operating lever 32. In this mechanism it is difficult for the operator to hold the sail in any particular angular position with respect to the body.

In Alexander, the sail pivots generally vertically about the axis defined by pins 20, 22 the arms 46 are driven by gears 44 which extend and retract the sail as the arms move from a vertical position to a horizontal position and then back again.

Alexander's system also includes a tube for reefing the mainsail, as well as a ratchet mechanism shown in FIGS. 8, 9 and 10 that lock the sail into a predetermined reefed position.

It does not have any ratchet mechanism that controls movement of the entire sail about the axis defined by pins 20, 22, which is the location of the present ratchet mechanism.

The Boyden, U.S. Pat. No. 5,120,070, also shows a ratchet-type mechanism through the mainsail illustrated in FIG. 5 of his drawings, but the ratchet mechanism does not act directly on the mast and instead operates by holding main sheet 9 in position, which of course is nothing more than a sheet commonly found on sailboats.

The Goldberg, U.S. Pat. No. 3,768,823, shows a body-held sail for use by an ice skater, but it is not physically attached to the human body and only held by the user's shoulders and hands. It is somewhat relevant in that it shows a mechanism for stretching the body sail, but stretching is effected by pulling ribs 14*a* and 16 apart rather than by tensioning the ribs with a sail embedded line in a manner similar to the stringing motion in a recurve bow.

The French Brevet D'Invention No. 1,499,954, Delivre Sep. 25, 1967, discloses a body sail for a roller skater. The sail assembly swings by hand-held arms 39 and 40, and there does not appear to be any mechanical vertical pivot axis. The sail does include what appears to be lines along its upper periphery at 48 and 49 but do not clearly exert a tensioning force on ribs 43 and 46.

And finally, the Hardt, U.S. Pat. No. 2,018,062, discloses a body sail for a skater with particular emphasis on a mechanism for extending the sail by pivoting arms 9 outwardly from a vertically downward hanging collapsed position. The patent does not appear to be particularly pertinent otherwise.

It is the primary object of the present invention to ameliorate the problems noted above in human body mounted sail assemblies and to provide one that is easier for the user to assemble and operate in flight and one which collapses into an improved and smaller envelope.

SUMMARY OF THE PRESENT INVENTION

In accordance with the present invention, an improved human body mounted sail assembly is provided including a rotatable mast with upper and lower horizontal braces that swing with the mast. The sail is held taut by the braces which are placed in tension by the sail and a bow-like string at the sail leech. The mast, braces and sail assembly can be locked in any desired angular position relative to the human back by an easy to operate pawl and ratchet mechanism on the base of the mast. The sail is collapsible utilizing push button quick release pivots at the inner ends of both the upper and lower braces.

While in the exemplary embodiment, there are provided two sail assemblies; i.e., two masts and two sails, it should be understood that the principles of the present invention apply to a single sail assembly. Other objects and advantages will appear more clearly from the following detailed description.

BRIEF DESCRIPTION OF THE DRAWINGS

FIG. 1 is a side view of the human form with the present human body mounted sail assembly carried thereby;

FIG. 2 is a side view of the sail assembly illustrated in FIG. 1 with the sails exploded from the sail braces;

FIG. 6 is a top view partly in section of the ratchet assemblies at the base of each of the masts;

FIG. 7 is a vertical section through one of the mast and ratchet assemblies, and;

DETAILED DESCRIPTION OF THE PREFERRED EMBODIMENT

Figure 3:
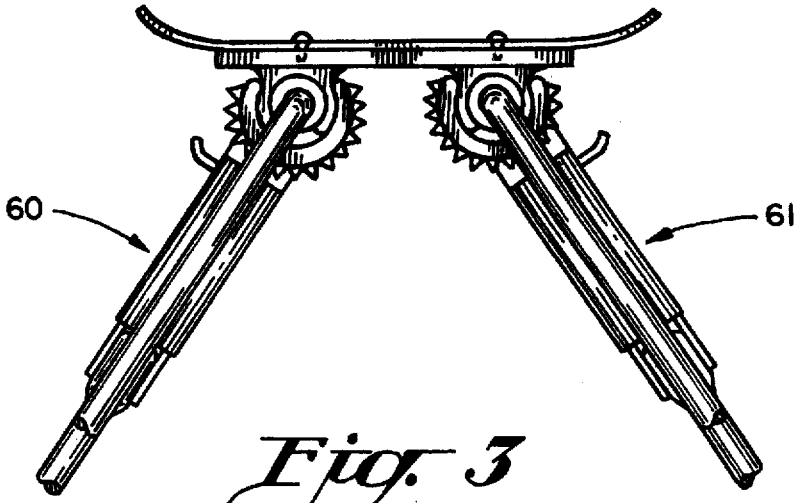
FIG. 3 is a top view of the present sail assembly, partly fragmented, illustrating both sail sub-assemblies.

As seen in the drawings and particularly FIGS. 1 to 3, the present human body mounted sail assembly 10 is illustrated strapped to a human form 11 in the process of skating on in-line roller skates 12.

The sail assembly 10 has a base including upper and lower body plates 12 and 13. Both the plates 12 and 13 are rigid plastic moldings and contoured to the human form, the upper being contoured to the central shoulder area and the lower being contoured around the upper portion of the buttocks to the user's lumbar region. Each of the support plates 12 and 13 have a plurality of holes therein to enable the mast and sails to be carried in a variety of positions to accommodate differing human body configurations.

Figure 4:
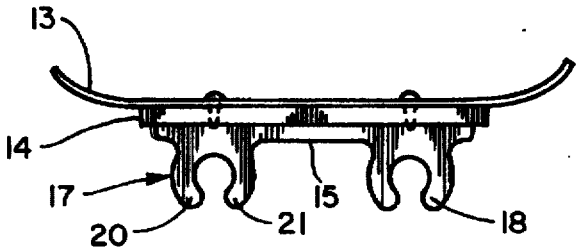
FIG. 4 is a top view of the lower mast supports.

As seen in FIG. 4, the bottom plate 13 carries a cross support 14 having a lower mast support 15 carried thereby that includes integral C-shaped clamps 17 and 18. Each of these C-shaped clamps includes somewhat flexible fingers 20 and 21 that spread slightly to snap-lock the sail masts bracket therein.

The upper plate has a mast support 23 fixed thereto that is similar to lower mast support 15.

As seen in FIGS. 2, 6 and 7, tubular masts 24 and 25 are snapped into and held by the C-shaped clamps 17 and 18 in the upper and lower mast bracket supports 15 and 23, and the masts are rotatable in the clamps. As seen in FIG. 7, the lower end of the masts has an integral deformation ring 27 that limits downward movement of the mast in the lower support 15 and a snap ring 28 that limits upward movement of the mast in the lower support. The masts 24 and 25 are free to slide vertically with respect to the upper support 23 to accommodate varying body sizes as well as to accommodate limited separation of the upper and lower supports 23 and 15 when the sail assembly is in use on the human body.

Each of the masts can be locked in any rotated position about their vertical axes by ratchet and pawl mechanisms 30 and 31 as seen in FIGS. 6 and 7.

Since these mechanisms are mirror images of one another, it should be understood that the description of mechanism 30 in FIG. 7 applies to mechanism 31 as well, and as seen therein, a one-piece housing 33 is provided having an integral housing annular boss portion 34 through which the lower end of the mast projects, held against ring 27 by an upper snap ring 35. Rotation is prevented between housing 33 and mast 24 by a key 37 so that the ratchet and pawl mechanisms 30 and 31 swing with the masts.

Housing 33 has an integral tubular portion 39 extending laterally therefrom having a central bore 40 that receives a pawl or detent member 41 having an enlarged head 42 slidable in bore 40 and limited in forward motion by stop 44, which is an annular flange at the proximal end of housing tubular portion 39.

The pawl 41 is biased to its extended position illustrated in FIGS. 6 and 7 by a coil compression spring 45 in bore 40 that engages and biases head 42.

The pawl 41 has a pointed end that engages between teeth 47 molded integrally with a plastic C-shaped clamp member 48. The C-shaped clamp member has undercut portions as illustrated at 50 that engage in corresponding undercuts 51 on the C-shaped clamps 17 and 18 to lock the members 48 to the C-shaped clamps 17 and 18.

Because the support 15, as well as the C-shaped clamps 17 and 18 and C-shaped members 48, are plastic moldings, they can flex slightly to permit snap action manual assembly and disassembly by the user.

Pawl 41 is released by the sailor using an outwardly extending operator 54 formed integrally with pawl head 42 operable by the sailor's fingers or thumb to release the pawl 41 from the teeth 47 and permit the sail assemblies to be reoriented and then locked by releasing the operator 54 into a new position.

As discussed above, there are two sail sub-assemblies indicated in FIG. 3 as sub-assembly 60 and sub-assembly 61. The parts of each sub-assembly are identical with the exception of the housing 39 for the ratchet and pawl mechanisms 30 and 31 which are simply mirror images of one another so that the description with respect to one of the sub-assemblies 60, 61 applies to the other as well.

As seen in FIGS. 1, 2 and 7, the upper end of the masts carries a pair of spaced plates 63 between which pivots an upper pivot brace base 64 about a pivot pin 65. As seen in FIG. 2, the upper pivot brace base 64 has an upper brace arm 66 projecting therefrom having a rearwardly upwardly extending portion 67, a horizontal portion 68, and a distal end boss 69 defining a reduced land 70. The brace 66 may take the form of a plastic extruded member formed into the desired shape after extrusion.

Figure 5:
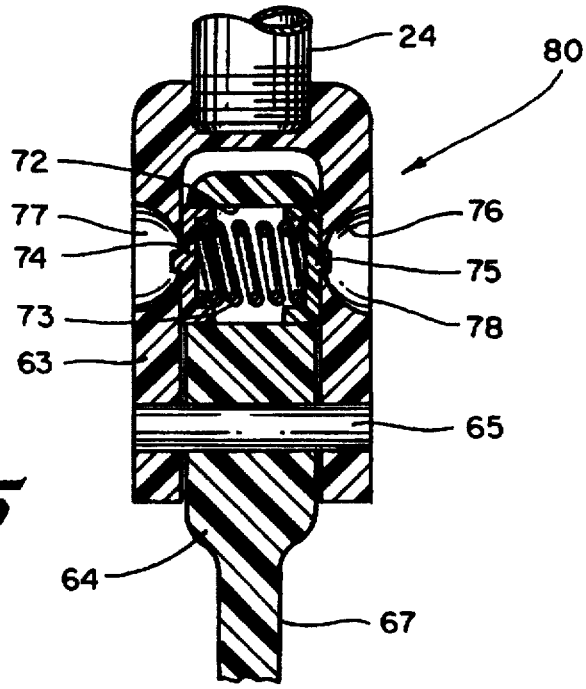
FIG. 5 is a longitudinal section of the quick release pivotal connections between both the upper and lower sail braces and the mast assembly.

As seen in FIG. 5, the upper pivot brace base 64 has a cylindrical through bore 72 with a pair of cup-shaped members 74 and 76 slidable therein that are biased outwardly by a coil compression spring 73 against the inside walls of the plates 63. These cup-shaped members 74 and 76 have finger operated central projections 75 extending outwardly therefrom into corresponding apertures in the inside walls of the plates 63 to lock the brace base 64 in its extended position. Finger recesses 77 and 78 in the outside walls of the plates 63 permit the user to place thumb and forefinger in the recesses, push the projections 75 together to clear the apertures in the plates 63 and thereby permit the base and brace arm to be pivoted, such as to the partly collapsed position illustrated in FIG. 8. When the user desires to raise the sail, he simply rotates the upper brace upwardly until projections 75 snap into the corresponding apertures in plates 63, which are coaxial with finger recesses 77 and 78. And here the cup-shaped members 74 and 76 snap outwardly under the influence of spring 73 locking the upper brace into its sail raised position.

The elements in FIG. 5 comprise a quick release locking pivot 80 for the upper brace 66. An identical quick release locking pivot 81 is provided connecting a lower brace member 82 to the projecting housing tubular portion 39 of the ratchet and pawl mechanism 30. Lower brace 82 has a downwardly and outwardly projecting portion 83, a horizontal portion 84 and a distal boss 85 defining a reduced land 86.

A flexible sail 90 is provided constructed of either a woven synthetic sail material or an impervious flexible plastic material, but in either event, the sail 90 is a fore and aft-type sail as opposed to a square sail. In a fore and aft-type sail, the luff 91 of the sail is directly attached to mast 24 by VELCRO.

Sail 90 is generally trapezoidal in configuration with a generally horizontal top or head portion 92, a downwardly and aft angled leech portion 93, and stepped foot portions **94*a* and 94*b* vertically spaced from one another. A head pocket 95 slides over the upper brace 66 and a foot pocket 96 slides over lower brace 82 and a stepped foot pocket 97 slides over a ratchet mounted partial brace 98 carried on top of the pawl and detent mechanisms 30 and 31**.

A bow-like line 100 having eyelets at both ends is carried inside or embedded in a leech pocket 101, and line 100 is slightly shorter than the normal spacing between the upper brace 66 and the lower brace 82 so that they bend slightly together to not only hold the braces and the sail together as a unit but also to tension the sail since pockets 95 and 96 are also spaced apart somewhat less than the relaxed spacing between the upper brace 66 and the lower brace 82.

In use, the upper and lower mast supports 23 and 15 can be fixed in the desired position to the body plates 12 and 13 to fit the user's anatomy and the mast and upper and lower braces assembled thereto without the use of any tools.

After the sail is slid over the braces in their collapsed positions, the braces are extended to their locked positions illustrated in FIG. 2 where projections 75 snap into their locking recesses.

Then the eyes in the end of bow line 100 are stretched into lands 70 and 86 providing the proper tensioning on the braces and at the same time forming a unit between the upper and lower braces and the sails.

Figure 8:
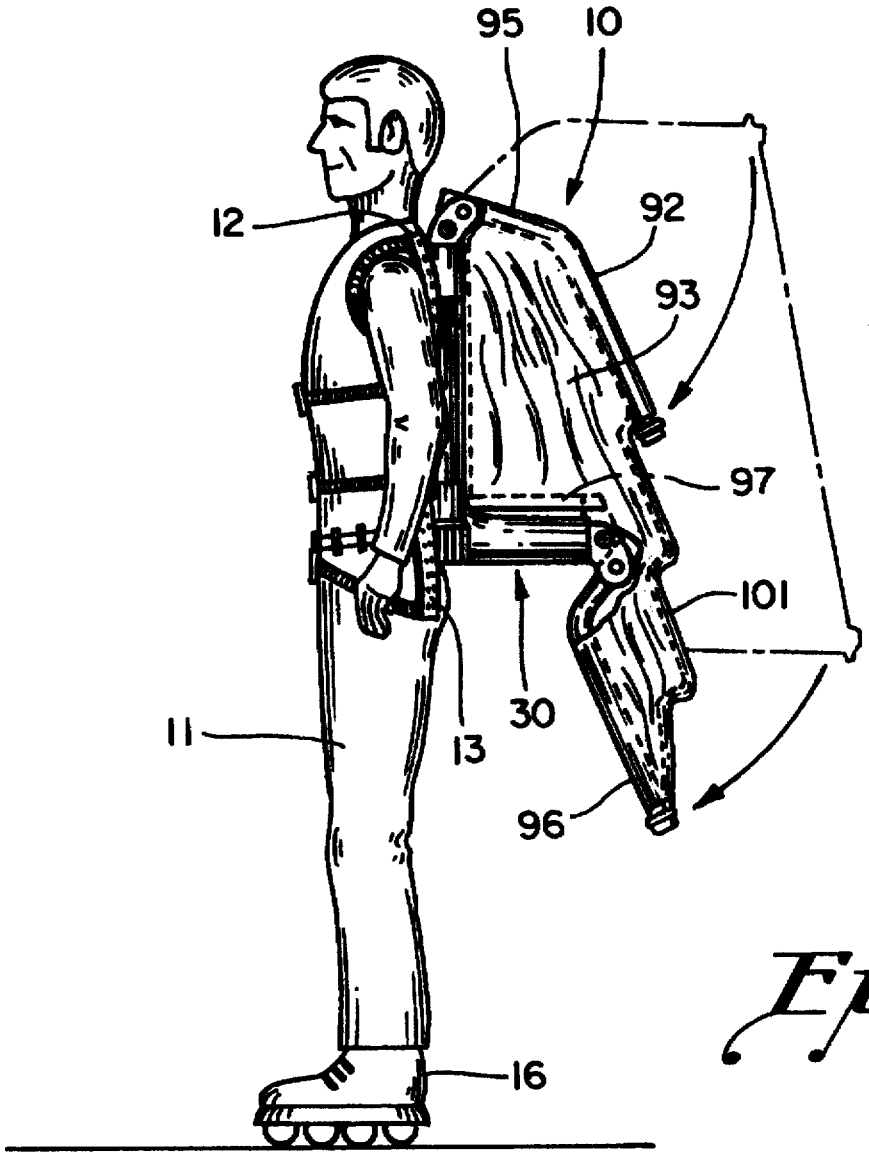
FIG. 8 is a side view of the human form with the present human body mounted sail assembly carried thereby in the process of being positioned in its sail collapsed envelope.

To collapse the sails, the user pushes inwardly on the thumb and index finger projections 75 in the quick release pivot lock mechanisms 80 and 81, and rotates the upper and lower braces downwardly past the positions illustrated in FIG. 8. If desired, the lower brace 82 can be rotated upwardly rather than downwardly as shown in FIG. 8.

The sub-sail assemblies 60 and 61 can be positioned and locked by the user in a wide variety of position combinations to maximize the force of the wind acting against the sails 90. Because effective use of the sail assemblies 60 and 61 when utilized for skating or bicycling must be quartering from either side to 90 degrees to the back, wind force is translated to forward force mostly by a pushing motion as opposed to an air foil effect, although there may be some small air foil enhancement involved.

I claim:

1. A human body sail assembly for sport and transportation, comprising: a base adapted to be attached to the human body with back supported portions, mast bracket means fixed to the back supported portions of the base, at least one mast having an axis carried by the bracket means, a sail support extending radially outward from the mast and rotatable about an axis substantially coaxial with the mast axis, a sail carried by said sail support extending outwardly therewith, and a ratchet means between said sail support and the base for indexing and releasably locking the sail support and sail about the mast axis in a plurality of fixed positions with respect to the base, and for setting the sail in a variety of angular positions in generally vertical planes.

2. A human body sail assembly as defined in claim 1, wherein there are two sail supports extending outwardly from the mast, one upper and one lower, said sail having head and foot edges fixed respectively to the upper and lower sail supports.

3. A human body sail assembly as defined in claim 1, wherein the ratchet means includes a plurality of teeth fixed with respect to the base or said sail support, and a releasable pawl carried by the other of the base and said sail support.

4. A human body sail assembly as defined in claim 2, wherein the sail has an embedded line having a length less than the spacing between the upper and lower sail supports attachable to the sail supports to tension the said supports toward one another and tension the sail.

5. A human body sail assembly for sport and transportation, comprising: a base adapted to be attached to the human body with back supported portions, mast bracket means fixed to the back supported portions of the base, at least one mast having an axis carried by the bracket means, a sail support extending radially outward from the mast and rotatable about an axis substantially coaxial with the mast axis, a sail carried by said sail support extending outwardly therewith, and a ratchet means between said sail support and the base for indexing and releasably locking the sail support about the mast axis in a plurality of fixed positions with respect to the base, said mast being pivotally mounted in the bracket means, said sail support including an upper sail support member and a lower sail support member fixed to and pivotal with the mast, said ratchet means including a plurality of teeth fixed with respect to the bracket means and a releasable pawl fixed with respect to the mast and said support means.

6. A human body sail assembly for sport and transportation, comprising: a base adapted to be attached to the human body with back supported portions, mast bracket means fixed to the back supported portions of the base, at least one mast having an axis carried by the bracket means, a sail support extending radially outward from the mast and rotatable about an axis substantially coaxial with the mast axis, a sail carried by said support extending outwardly therewith, and a ratchet means between said support and the base for indexing and releasably locking the sail support and the sail about the sail support axis to a plurality of fixed positions with respect in the base and for setting the sail in a variety of angular positions in generally vertical planes, there being two sail supports extending outwardly from the mast, one upper and one lower, said sail having head and foot edges fixed respectively to the upper and lower sail supports, said sail has an embedded line having a length less than the spacing between the upper and lower sail supports attachable to the sail supports to tension the said supports toward one another and tension the sail.

7. A human body said assembly for sport and transportation, comprising: a base adapted to be attached to the human body with back supported portions, mast bracket means fixed to the back supported portions of the base, at least one mast having an axis carried by the bracket means, a sail support extending radially outward from the mast and rotatable about an axis substantially coaxial with the mast axis, a sail carried by said sail support extending outwardly therewith, and a ratchet means between said sail support and the base for indexing and releasably locking the sail support and sail about the mast axis in a plurality of fixed positions with respect to the base and for setting the sail in a variety of angular positions in generally vertical planes, the mast being pivotally mounted in the bracket means, said sail support including an upper said support member and a lower sail support member fixed to and pivotal with the mast, said ratchet means including a plurality of teeth fixed with respect to the bracket means and a releasable pawl carried with respect to the bracket means and a releasable pawl carried with respect to the mast and said support means.

8. A human body sail assembly for sport and transportation enhancement, comprising: a base adapted to be attached to the human body with back supported portions, mast bracket means fixed to the back supported portions of the base, at least one mast rotatably supported on the back supported portions, at least one generally horizontal sail support extending radially outward from and fixed to the mast, and a sail fixed to the sail support and pivoted with the mast and said support to achieve the desired position between the human body and wind direction, said sail having a forward generally vertical leech portion extending outwardly from the mast, and means to collapse the sail including quick release pivot means on the sail support.

9. A human body sail assembly as defined in claim 8, wherein the quick release pivot means includes a general horizontal pivot on the said sail support and a spring biased locking pin spaced a short distance from the pivot.

10. A human body sail assembly as defined in claim 8, wherein the sail support includes a generally horizontal upper brace extending outwardly from an upper portion of the mast and a generally horizontal lower brace extending outwardly from a lower end of the brace.

11. A human body sail assembly for sport and transportation enhancement, comprising: a base adapted to be attached to the human body with back supported portions, mast bracket means fixed to the back supported portions of the base, at least one mast rotatably supported on the back support portions, upper and lower generally horizontal sail supports extending outwardly from and fixed to the mast, and a sail fixed to the sail supports and pivotal with the mast and said sail support to achieve the desired position between the said human body and wind direction, said sail having a forward generally vertical leech portion extending outwardly from the mast, and means to collapse the sail including quick release pivot means on the sail supports, said quick release pivot means including a quick release pivot means both on the upper and lower braces adjacent said mast.

12. A human body sail assembly for sport and transportation, comprising: a base adapted to be attached to the human body having a back supported portion, at least one generally vertical mast rotatably mounted in supported portions, an upper sail brace having a distal end connected to and extending outwardly from an upper portion of the mast, a lower sail brace having a distal end connected to and extending outwardly from a lower portion of the mast, a sail extending between and connected to the upper and lower braces, and means to tension the sail on the brace including means connecting the upper and lower braces biasing them toward one another.

13. A human body sail assembly as defined in claim 12, wherein the means biasing the upper and lower braces toward one another includes a bow-like line in the sail connecting the distal ends of the upper and lower braces, said line having a length less than the normal spacing between the distal ends of the upper and lower braces without the sail raised.

14. A human body sail assembly as defined in claim 12, wherein there are two mast, braces, and sail assemblies on the supported portions.

* * * * *